United States Patent [19]

Outsuka et al.

[11] Patent Number: 4,591,543

[45] Date of Patent: May 27, 1986

[54] METHOD OF PURGING EXCESS OF LIQUID DEVELOPER IN ELECTROPHOTOGRAPHIC APPARATUS

[75] Inventors: Shuichi Outsuka; Akinori Kimura, both of Kanagawa, Japan

[73] Assignee: Fuji Photo Film Co., Ltd., Minami-ashigara, Japan

[21] Appl. No.: 762,611

[22] Filed: Aug. 5, 1985

[30] Foreign Application Priority Data

Aug. 7, 1984 [JP] Japan ..... 59-164241

[51] Int. Cl.[4] ..... G03G 13/10

[52] U.S. Cl. ..... 430/125; 430/117; 118/652; 118/660; 118/401; 118/63

[58] Field of Search ..... 118/652, 401, 63, 660; 430/117, 118, 119, 125

[56] References Cited

U.S. PATENT DOCUMENTS 4,181,094 1/1980 Gardiner ..... 118/63 X

*Primary Examiner*—John D. Welsh

*Attorney, Agent, or Firm*—Abelman Frayne Rezac & Schwab

[57] ABSTRACT

A method of purging an excess of a liquid developer in an electrophotographic apparatus including the steps of pressing an electrophotosensitive film formed with an electrostatic latent image against an opening of a developing chamber to close the opening, supplying the liquid developer into the developing chamber to toner-develop the electrostatic latent image, discharging the liquid developer, and supplying gas under pressure into the developing chamber to purge the liquid developer remaining in the developing chamber as well as excess of the liquid developer attaching to the electrophotosensitive film. In the method, the flow rate of the gas at the surface of the electrophotosensitive film may be changed according to a predetermined time chart so that the excess of the liquid developer remaining after the process of development can be quickly purged without degrading the picture quality.

4 Claims, 5 Drawing Figures

METHOD OF PURGING EXCESS OF LIQUID DEVELOPER IN ELECTROPHOTOGRAPHIC APPARATUS

BACKGROUND OF THE INVENTION

1. Field of the Invention

This invention relates to an electrophotographic apparatus of the type in which electrostatic latent images recorded on an electrophotosensitive film are toner-developed one frame after another with a liquid developer, and more particularly to a method of quickly purging an excess of the liquid developer remaining after the process of development, without degrading the picture quality.

2. Description of The Prior Art

In an electrophotographic recording system of wet type, picture image data are recorded on an electrophotosensitive film by five sequential steps, that is, the steps of charging, exposure, developing, drying and fixing. Toner images of electrostatic latent images of picture image data are electrically held on such an electrophotosensitive film, and it is necessary to immediately fix those toner images. Therefore, various process heads have been developed in an attempt to shorten the length of time required for the image processing and to reduce the size of the individual processing sections, as disclosed in, for example, U.S. Pat. Nos. 3,972,610 and 4,461,561.

Also, a process head proposed by the inventors is disclosed in Japanese unexamined Patent Publication No. 59-100479 (corresponding to U.S. Ser. No. 578522 filed on Feb. 9, 1984), and an improved version of the proposed process head is shown in a perspective view in FIG. 1. Referring to FIG. 1, the improved process head generally designated by the reference numeral 101 includes a charging and exposure section 103 for charging and exposure of an electrophotosensitive film 102, a developing section 104 for toner-developing with a liquid developer an electrostatic latent image recorded on the electrophotosensitive film 102, a drying section 105 for drying the liquid developer on the electrophotosensitive film 102, and a fixing section 106 for fixing the toner image on the electrophotosensitive film 102, which sections are arranged in the sequential order described above.

A predetermined area of the electrophotosensitive film 102 is charged by corona discharge from a corona wire (not shown) incorporated in the charging and exposure section 103, and picture image data (not shown) are exposed to the electrophotosensitive film 102 by a recording lens 107 mounted on the process head 101 opposite to the corona wire. The electrostatic latent image formed on the electrophotosensitive film 102 as a result of exposure is toner-developed with a liquid developer in the developing section 104, and, after the liquid developer is applied to the electrophotosensitive film 102 it is exposed to a drying gas such as air supplied to the drying section 105, and the toner image is head-fixed to the electrophotosensitive film 102 by a fixing element such as a xenon lamp (not shown) incorporated in the fixing section 106.

FIG. 2 shows a developing system including such a process head 101. Referring to FIG. 2, a liquid developer 110 contained in a toner bottle 109 is pumped up by a pump 108 into a liquid developer tank 111 disposed above the process head 101, and an overflow pipe 112 extends downward from the liquid developer tank 111 so that a constant quantity of the liquid developer 110 is always held in reserve in the liquid developer tank 111. FIG. 3 is a sectional view of the developing section 104. As shown in FIG. 3 which is a sectional view of the developing section 104, a liquid supply pipe 114 extends from the liquid developer tank 111 to the process head 101 to supply the liquid developer 110 contained in the liquid developer tank 111 into a developing chamber 113 of the developing section 104 utilizing potential energy, and a flow control value 115 controlling the flow of the liquid developer 110 into the developing chamber 113 is disposed midway of the liquid supply pipe 114. Therefore, the flow rate of the liquid developer 110 supplied into the developing chamber 113 is maintained substantially constant to attain uniform development. It is apparent that a high-performance toner pump may be used to directly supply the liquid developer 110 into the developing chamber 113. As shown in FIG. 2, a blower 117 supplying compressed gas or air is connected by an air supply pipe 118 to the developing chamber 113 so that the liquid developer 110 remaining in the developing chamber 113 after termination of supply of the liquid developer 110 as well as an excess of the liquid developer 110 attaching to the electrophotosensitive film 102 can be discharged into a drain pipe 116.

During the development of the electrophotosensitive film 102, a suction slit 112 formed adjacent to the developing chamber 113 is maintained at a negative pressure through a section pipe 119 communicating with a vacuum pump (not shown) so as to suck the portion of the liquid developer 110 exuding from the developing chamber 113. Then, after pressing the electrophotosensitive film 102 against an opening 121 of the developing chamber 113 by a film pressing plate 120 to close the opening 121, the valve 115 is opened for a predetermined period of time to supply a predetermined quantity of the liquid developer 110 from the liquid developer tank 111 into the developing chamber 113 and, thence, into the drain pipe 116, thereby toner-developing the electrostatic latent image formed on the electrophotosensitive film 102. Subsequently, the gas flower 117 is driven to feed compressed air into the developing chamber 113 to purge any excess of the remaining liquid developer 110 from the surface of the electrophotosensitive film 102. As another means for supplying compressed air, the combination of a compressed air accumulator tank and a pressure regulating valve mounted midway of the air supply pipe 118 is also known.

However, as will be apparent from FIG. 3, the liquid passage in the developing chamber 113 must have a small cross-sectional area so that the liquid developer 110 flows necessarily along the surface of the electrophotosensitive film 102. As a result, immediately after the termination of supply of the liquid developer 110, a portion of the liquid developer 110 remains in the developing chamber 113 due to the capillary phenomenon. When air at high pressure is blown into the developing chamber 113 through the air supply pipe 118 under such a state, the excess of the liquid developer 110 is instantaneously jetted from the developing chamber 113 toward and into the drain pipe 116. It has been found that the toner image formed on the electrophotosensitive film 102 tends to be damaged by the jetted liquid developer 110, resulting in degradation of the picture quality attributable to, for example, non-uniform picture density.

OBJECT OF THE INVENTION

It is a primary object of the present invention to provide, in an electrophotographic apparatus of the type in which electrostatic latent images recorded on an electrophotosensitive film are toner-developed one frame after another with a liquid developer, a method of quickly purging an excess of the liquid developer remaining after the process of development, without degrading the picture quality.

SUMMARY OF THE INVENTION

In accordance with the present invention, there is provided a method of purging an excess of a liquid developer in an electrophotographic apparatus, comprising the steps of pressing an electrophotasensitive film formed with an electrostatic latent image against an opening of a developing chamber to close the opening, supplying the liquid developer into the developing chamber to toner-develop the electrostatic latent image, discharging the liquid developer, and supplying gas under pressure into the developing chamber to purge the liquid developer remaining in the developing chamber as well an excess of the liquid developer attaching to the electrophotosensitive film, said method further comprising the step of changing the flow rate of the gas supplied into the developing chamber and flowing along the surface of the electrophotosensitive film during the process of development.

Therefore, according to the present invention, at the starting time of supplying the gas into the developing chamber filled with the liquid developer, the flow rate of the gas flowing along the surface of the electrophotosensitive film is decreased to decrease the flow rate of the down-flowing liquid developer, so as to prevent leakage of the liquid developer out of the opening of the developing chamber. Further, undesirable stripping of the toner forming the toner image from the electrophotosensitive film due to the high flow rate of the down-flowing liquid developer can be prevented to minimize degradation of the picture quality attributable to, for example, non-uniform picture density. Furthermore, by increasing the flow rate of the gas after complete purging of the excess of the liquid developer, the electrophotosensitive film can be quickly dried, thereby shortening the period of time required for drying in the succeeding drying step.

DETAILED DESCRIPTION OF THE PREFERRED EMBODIMENTS

The flow rate of compressed gas may be gradually increased in a stepless mode. However, it is generally easy to change over the flow rate between two ranges for the purpose of control. From the practical aspect of shortening the processing period of time, a flow rate of more than 5 mm./sec. is preferable as a low-speed range. Also, from the aspect of preventing leakage of the liquid developer out of the opening of the developing chamber and from the aspect of preventing degradation of the picture quality attributable to, for example, non-uniform picture density, the flow rate in the low-speed range is preferably less than 50 cm./sec. For example, in the case of a developing chamber having a square opening of $10^2$ mm. and a depth of 0.5 mm., a flow rate of about 3 cm./sec provides the best result. On the other hand, the flow rate in a high-speed range is preferably more than 50 cm./sec. In the above case, the flow rate in the high-speed range was set at 10 m./sec. These flow rates are those relative to the surface of the electrophotosensitive film, and the flow rate in the low-speed range coincides with the flow rate of the down-flowing liquid developer.

To determine the timing of change-over of the flow rate of the compressed gas, a pressure sensor may be provided to sense the internal pressure of the developing chamber or the pressure at a position near the developing chamber, and a change-over signal may be generated upon sensing a pressure variation. However, it is generally simpler to generate such a change-over signal one the basis of an empirically determined time chart. In other words, the compressed gas is supplied at the low flow rate for a predetermined period of time and, then, the flow rate is changed over to the high flow rate.

Simplest means for attaining the flow rate change-over of the compressed gas is provision of a buffer of a suitable volume midway of the gas supply pipe connecting the compressed gas source to the developing chamber. The buffer may be an air chamber having a volume of about 0.1 to 1 liter disposed between the blower and the developing chamber and may have such a function that the flow rate of the compressed gas is not increased until the liquid developer remaining in the developing chamber is completely purged. Also, a valve controlling the flow of the compressed gas may be provided so that the compressed gas can be supplied at the low flow rate for a predetermined period of time after completion of the process of development. As another method, a compressor, a pump or a fan used as the compressed gas source may be initially duty-controlled to establish a state similar to lowering of the output relative to the rated output, or the voltage applied to such a unit may be suitably varied to change-over the flow rate of the compressed gas.

Figure 1:
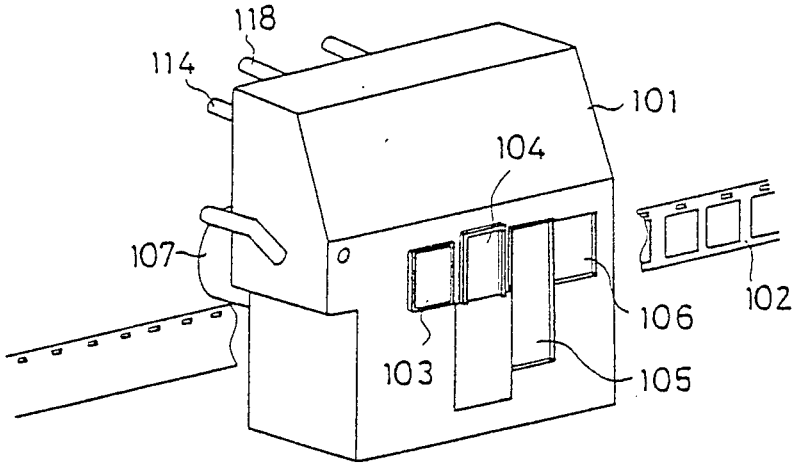
FIG. 1 is a perspective view showing the external appearance of a process head of an electrophotosensitive apparatus to which the present invention is applied.
Figure 2:
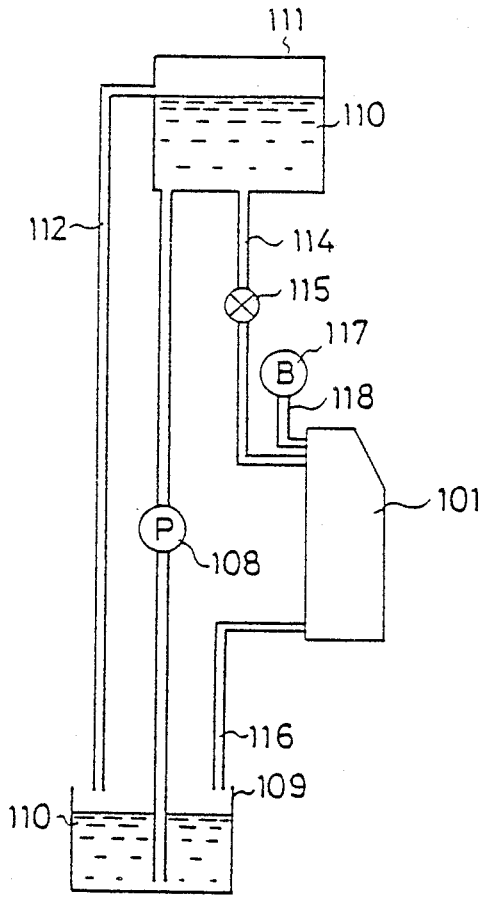
FIG. 2 is a diagrammatic view showing the concept of a system supplying a liquid developer to the process head.
Figure 3:
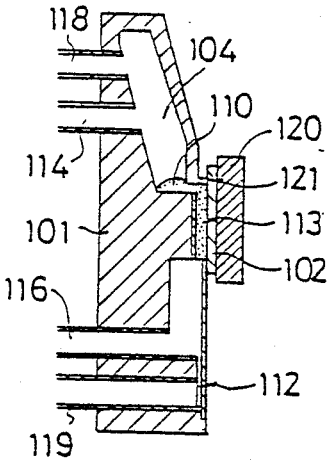
FIG. 3 is a sectional view showing the internal structure of a developing section of the process head.
Figure 4:
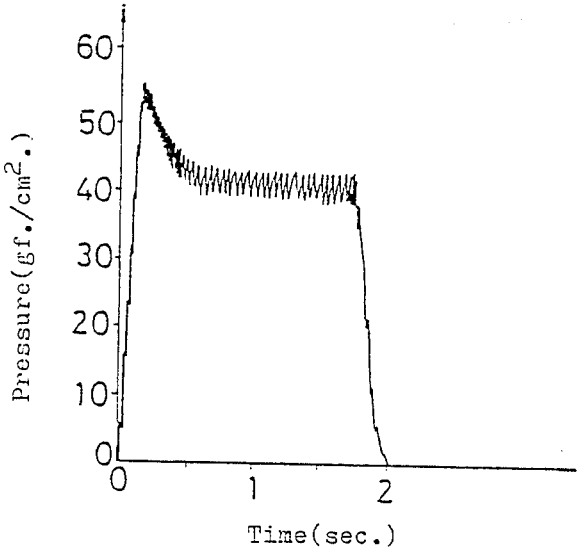
FIG. 4 is a graph showing a prior art manner of controlling the supply of compressed gas.

A diaphragm valve type blower capable of supplying compressed gas at a rate of 6 liter/min. is driven by application of its rated voltage to operate at its rated speed for supplying compressed gas into the developing chamber of the structure shown in FIG. 3, thereby purging the portion of the liquid developer remaining in the developing chamber. As a result, a pressure of about 55 gf./cm. is built up in the developing chamber immediately after starting of supplying the compressed gas as shown in FIG. 4, and the remaining liquid developer is substantially instantaneously purged at a high flow rate. Upon completion of the purging of the liquid developer, the internal pressure of the developing chamber becomes constant, and any excess of the liquid developer still remaining in the developing chamber is further purged. Unless the flow rate of compressed gas supplied from the flower is changed over from its high rating to its low rating, the liquid developer will be instantaneously discharged from the developing chamber at the high flow rate, giving rise to such a defect that the toner image formed on the surface of the electrophotosensitive film is partly stripped resulting in a non-uniform picture density.

Figure 5:
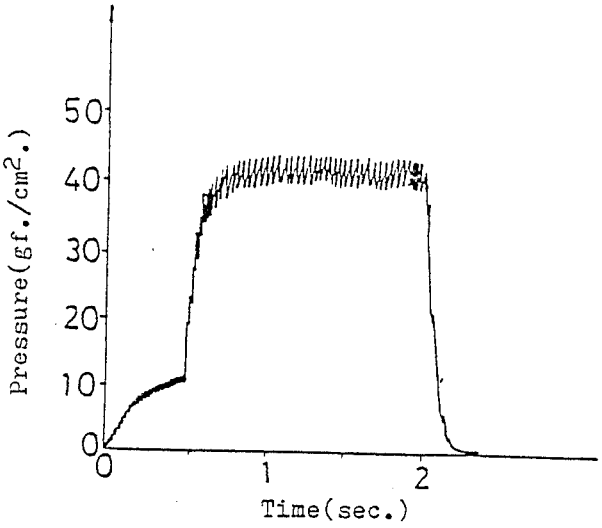
FIG. 5 is a graph showing a manner of controlling the supply of compressed gas according to an embodiment of the present invention.

The graph shown in FIG. 5 is similar to that shown if FIG. 4 except that the flow rate of compressed gas supplied from the blower is changed over between the high rating and the low rating. Within the period of time of 0.5 sec after starting to supply compressed gas, the blower is driven at a voltage which is 1/5 of the rated voltage thereby discharging at a low flow rate the liquid developer remaining in the developing chamber. Subsequently, compressed gas is supplied at the rate of 6 liter/min. to purge any excess of the liquid developer remaining still in the developing chamber. The purging of the remaining liquid developer in a manner as shown in FIG. 5 is effective in that a picture of good quality free from any non-uniform development can be obtained.

The control of the flow rate of compressed gas supplied from the blower is in no way limited to the change-over between the high rating and the low rating described above. The flow rate may be changed over between a plurality of stages of progressively increasing quantities. It is also apparent that compressed gas may be initially supplied at the low flow rate followed by the high flow rate and may then be changed over to the low flow rate again. For the purpose of expediting drying of the electrophotosensitive film after the purging of the excess of the liquid developer, it is advantageous that the flow rate of the compressed gas is high at the time of termination of supply. Further, although the aforementioned embodiment has referred to the application of the present invention to a liquid developer supplying system in which a flower for supplying compressed gas is disposed externally for removing the liquid developer by purging, the present invention is equally effectively applicable to a system where a suction pump is disposed at the liquid developer draining of the developing chamber for removing the liquid developer by suction. That is, it is merely required to change the flow rate of the liquid developer flowing out from the developing chamber toward the liquid developer draining outlet. In the case of the removal utilizing the suction, the pressure at the draining outlet should be controlled to be changed over to a higher negative pressure from a lower one.

We claim:

1. A method of purging an excess of a liquid developer in an electrophotographic apparatus, comprising the steps of pressing an electrophotosensitive film formed with an electrostatic latent image against an opening of a developing chamber to close the opening, supplying the liquid developer into said developing chamber to toner-develop said electrostatic latent image, discharging said liquid developer, and supplying gas under pressure into said developing chamber to purge said liquid developer remaining in said developing chamber as well as excess of said liquid developer attaching to said electrophotosensitive film, said method further comprising the step of changing the flow rate of said gas supplied into said developing chamber and flowing along the surface of said electrophotosensitive film during the process of development.

2. A method as claimed in claim 1, wherein said gas is supplied at a low flow rate while said developing chamber is filled with said liquid developer, and the flow rate is changed over to a high flow rate after said liquid developer is discharged from said developing chamber.

3. A method as claimed in claim 2, wherein the flow rate of said gas is changed over according to a predetermined time chart.

4. A method as claimed in claim 2, wherein said low flow rate lies within the range of from 5 mm./sec. to 50 cm./sec., and said high flow rate is more than 50 cm./sec.

* * * * *